United States Patent [19]

Frank

[11] Patent Number: 4,749,189

[45] Date of Patent: Jun. 7, 1988

[54] EXERCISE MACHINE FOR HOCKEY PLAYERS

[76] Inventor: Stephen M. Frank, 624 W. 11th St., Willmar, Minn. 56201

[21] Appl. No.: 786,589

[22] Filed: Oct. 11, 1985

[51] Int. Cl.[4] ..... A63B 21/04

[52] U.S. Cl. ..... 272/136; 272/142; 272/900

[58] Field of Search ..... 272/135, 136, 137, 138, 272/139, 142, 143, 900; 273/67 A

[56] References Cited

U.S. PATENT DOCUMENTS

| | | | |
|---|---|---|---|
| 754,992 | 3/1904 | Grabner | 272/142 |
| 807,670 | 12/1905 | Grabner | 272/136 X |
| 2,131,570 | 9/1938 | Riley | 272/142 X |
| 2,848,234 | 8/1958 | Brandon . | |
| 3,162,442 | 12/1964 | Karlik | 272/136 |
| 3,462,156 | 8/1969 | Gentry . | |
| 3,618,942 | 11/1971 | Bates . | |
| 4,111,419 | 9/1978 | Pellegrino . | |
| 4,243,219 | 1/1981 | Price | 272/900 X |
| 4,328,964 | 5/1982 | Walls . | |
| 4,402,504 | 9/1983 | Christian . | |
| 4,449,708 | 5/1984 | Humphrey . | |
| 4,521,013 | 6/1985 | Dofel . | |
| 4,592,545 | 6/1986 | Sagedahl et al. | 272/136 X |
| 4,685,670 | 8/1987 | Zinkin | 272/136 |

FOREIGN PATENT DOCUMENTS

| | | | |
|---|---|---|---|
| 213362 | 10/1966 | Sweden | 272/120 |
| 3677 | of 1896 | United Kingdom | 272/136 |

*Primary Examiner*—Richard J. Apley
*Assistant Examiner*—Robert W. Bahr
*Attorney, Agent, or Firm*—Merchant, Gould, Smith, Edell, Welter & Schmidt

[57] ABSTRACT

An exercise machine for hockey players includes a cable elastically tethered to a frame on one end and to the blade of a hockey stick on the other. A first pair of pulleys are mounted to the base of the frame while a second pair are suspended above from springs. The cable runs over a first elevated pulley, under a base mounted pulley, over the other elevated pulley and back under the base mounted pulley wherein the springs provide a retracting force on the cable as it is pulled away from the machine by the blade of the hockey stick.

3 Claims, 3 Drawing Sheets

EXERCISE MACHINE FOR HOCKEY PLAYERS

TECHNICAL FIELD OF THE INVENTION

The present invention pertains generally to the field of exercise equipment, and more particularly to exercise equipment for hockey players.

BACKGROUND OF THE INVENTION

Hockey is now a sport of widespread popularity in the United States, Canada and Europe. Due in part to this popularity and in part to the increasingly competitive nature of the sport many amateur and pro players now engage in conditioning activities which can be performed away from the rink.

One popular off-ice conditioning activity is weight training, which is effective for building, strengthening and toning muscles for hockey play. While weight training is suitable for general muscle development, particularly of the upper body and legs, it is not readily adaptable for the isolated development of stick handling muscles as for example used for passing, shooting and face-offs. Accordingly, the present invention provides a hockey muscle exercising machine particularly adapted for this purpose.

SUMMARY OF THE INVENTION

The present invention provides an exercise machine with which a hockey player may strengthen stick handling muscles. The exercise machine includes a frame having a floor level portion and an elevated portion with the floor portion having mounted thereto a pair of floor level pulleys. One of the pulleys is mounted near the front of the frame and the other is rearwardly mounted near the middle of the frame. A pair of elevated pulleys are suspended from the elevated portion of the frame generally above the floor level pulleys with elastic suspension members.

Preferably, the elevated pulleys are positioned relative to the front and rear of the frame so that one is in between the floor pulleys and the other is to the rear of the floor pulley mounted in the middle of the frame. A cable is anchored to the frame at a lower rear location thereof and extends up over the rear elevated pulley, down under the rear mounted floor pulley, up over the front elevated pulley and down under the front floor pulley. The cable is terminated at a coupling member. A hockey stick is provided, and includes mounted on the blade thereof a further coupling member by which the stick may be connected to the coupling member on the cable. Accordingly, there is provided an elastically tethered hockey stick which an individual hockey player may use to practice stick handling, shooting and the like against a resisting force whereby muscles used in those movements are strengthened and toned. These and other salient features of the invention, including more subtle aspects thereof will be described in more detail with reference to the ensuing specification and the drawing.

DETAILED DESCRIPTION OF THE INVENTION

Figure 1:
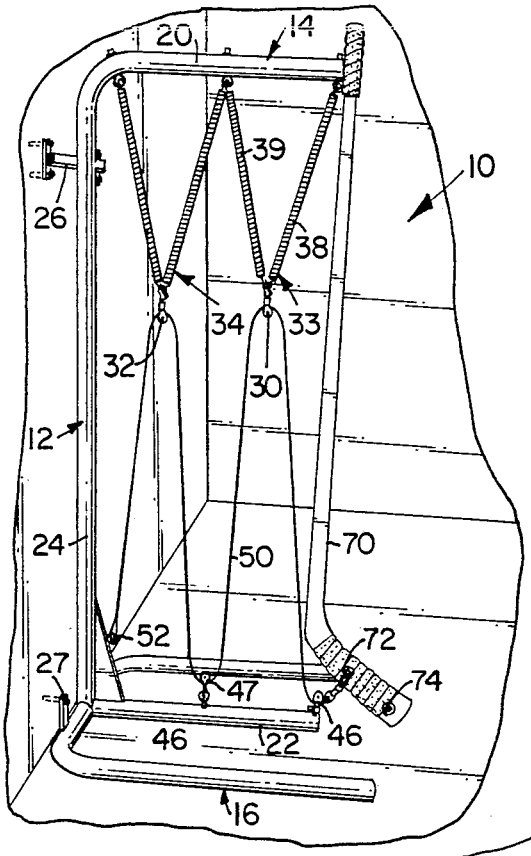
FIG. 1 is a side perspective view of the hockey muscle exercise machine according to the present invention.
Figure 2:
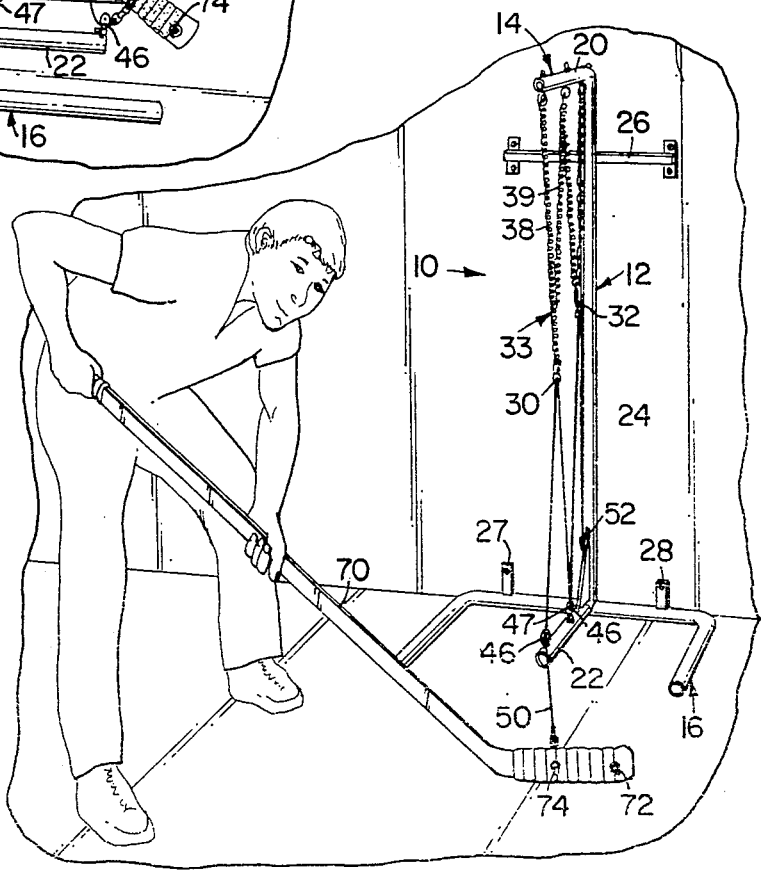
FIG. 2 is a front perspective view illustrating the manner of use of the hockey muscle exercise machine according to the present invention.
Figure 3:
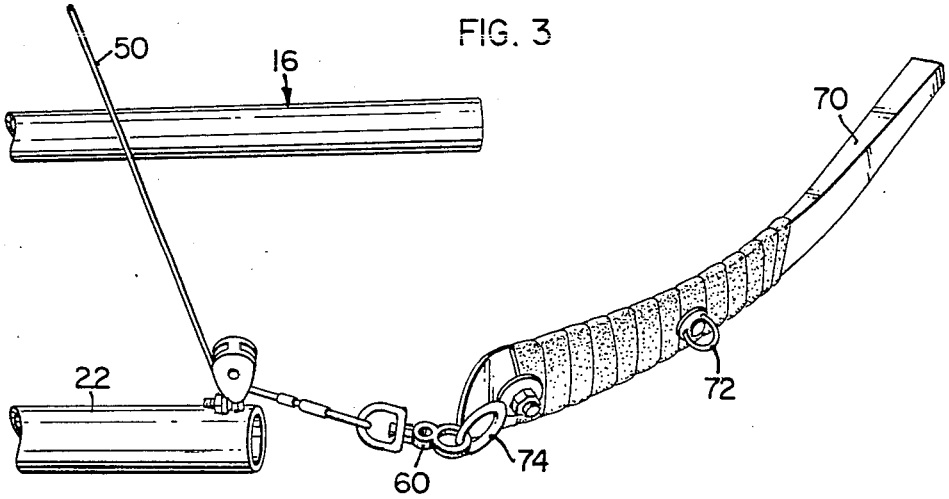
FIG. 3 is a fragmentary view showing the connection of the hockey stick to the machine.

Referring now to FIGS. 1, 2 and 3, in which like elements are designated with like reference numerals, the hockey muscle exercise machine of the present invention will be described. The exercise machine 10 includes a frame 12 having a stand or base portion 16 for supporting the frame upright on the floor, and an elevated upper portion 14. Upper and lower portions 14 and 16 each include an elongate member, or arm, 20 and 22, respectively, which are spaced apart in a parallel relationship with each other. Frame 12 further includes an upright member 24 which includes mounted to the back side thereof a cross member 26 which is preferably mounted to a wall with bolts or other suitable means. Frame 12 also includes mounting members 27 and 28 on the base portion 16, which are also preferably mounted to a wall with bolts or the like. Thus, frame 12 may be anchored to a wall of a basement, park house, school, etc.

A pair of "elevated" pulleys 30 and 32 are suspended from arm 20 with spring assemblies 33 and 34 respectively. As shown with particular respect to assembly 33, each of the assemblies includes first and second springs 38 and 39 connected to arm 20 and which are preferably detachably connected to the pulley to permit reconfiguration, as will be explained in more detail below. As an alternative to springs, it is contemplated that elastic rubber cords or the like could be used. A pair of "base" pulleys 46 and 47 are mounted to member 22 at floor level. Pulley 46 is mounted near the front of frame member 22, while pulley 47 is rearwardly mounted below and in between pulleys 30 and 32. Preferably, pulleys 46 and 47 are detachably connected to member 22 to provide for reconfiguration.

A cable 50 is provided, and is anchored with an eyelet bolt 52 at a rear base location on frame 12. Cable 50 extends from eyelet 52 over pulley 32, under pulley 47, over pulley 30, and under pulley 46, which if desired may be swivel mounted.

As shown best with respect to FIG. 3, cable 50 is terminated at a clip, or coupling, 60. A hockey stick 70 is provided with at least one coupling 72 which is bolted to the blade of the stock. Preferably, a second coupling 74 is bolted to the tip of the blade. Accordingly, stick 70 may be attached to cable 50 in either one of two places. Thus, the present invention provides apparatus for elastically and retractably tethering a hockey stick.

The use and operation of the exercise machine 10 is self evident but will be explained briefly nonetheless, with particular reference to FIG. 2. In order to practice a wrist shot or slap shot for instance, the player holds hockey stick 70 in its perferred manner, stands away from machine 10 and then practices the shooting motion against the elastic resistance of spring assemblies 33 and 34. As the stick is drawn away from machine 10 cable 50 pulls down on spring assemblies 33 and 34 to provide a resistance to the hockey player as the stick is moved away from the machine, and to retract the cable and the blade as the player so allows. For another example, the player may position himself facing the machine in a face-off posture, practicing face-off technique, pulling the stick towards him against the resistance of the machine 10.

Figure 5:
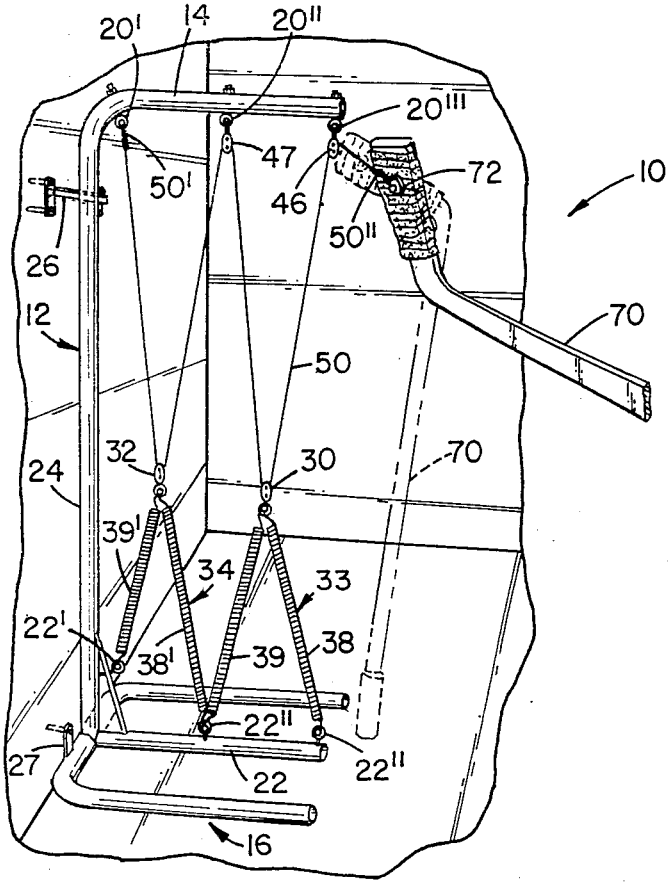
FIG. 5 is a side perspective view of the machine according to the present invention showing springs and pulleys in reverse positions.

For yet another example, the hockey stick may be a goalie stick, and goalie stick movements may be practiced. Moreover, to practice slapshots the springs and pulleys may be flip-flopped (as shown in FIG. 5) so that the free end of cable 50 exits from the front end of arm 20. For this purpose, eyelet bolt 52 may be used as one of the anchors for the rear spring assembly. Of course, these are but several examples of the manner in which the machine may be used. It is contemplated that various other stick handling exercises in addition to those described may be devised.

As mentioned above, at least one of the two springs in each assembly may be detached from its pulley. Thus, if the user wants to work against less resistance he or she can simply detach a spring. Moreover, it is contemplated that the resistance force of the machine may be readily changed by switching between springs of different elasticity.

Figure 4:
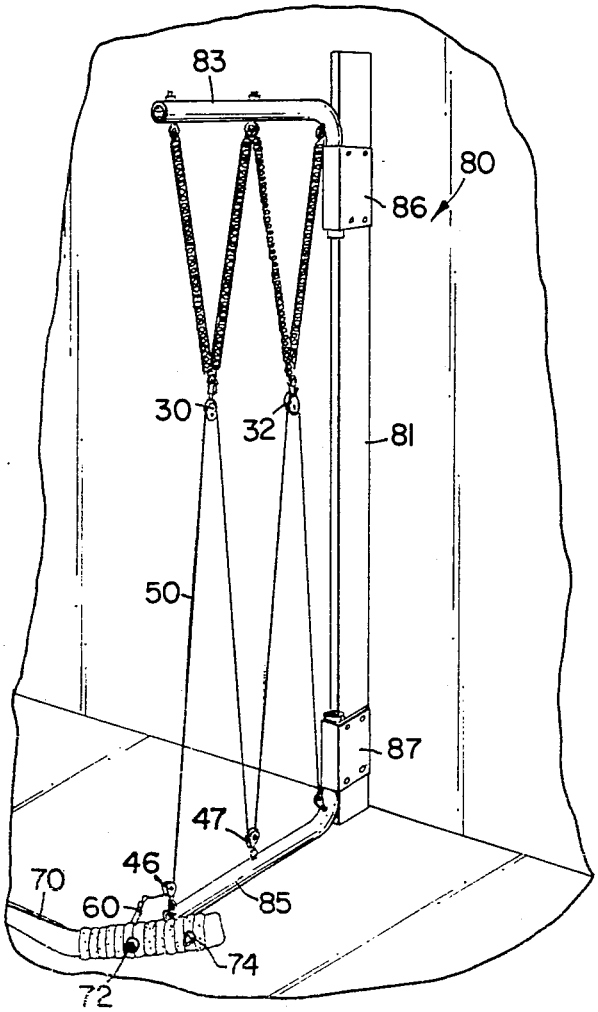
FIG. 4 is a perspective view of an alternate embodiment of the invention.

An alternate embodiment of the present invention is shown in FIG. 4. Alternate embodiment 80 is substantially the same as embodiment 10, and like components of the two embodiments are identified with the same reference numerals. As opposed to being self-supporting like embodiment 10, alternate embodiment 80 is adapted for mounting to a two-by-four wall stud 81, as may be found for instance in an unfinished basement. Of course, the mounting bracket of alternate embodiment 80 can be easily adapted for mounting to other wall structures or upright members. For instance, a flat plate could be provided for anchoring to a cement wall or other flat surface.

Alternate embodiment 80 includes a pair of elongate members, or arms, 83 and 85, which provide the same function as members 20 and 22, respectively, of frame 12. However, members 83 and 85 are each mounted to two-by-four 81 via U-shaped mounting brackets 86 and 87, respectively. Preferably, members 83 and 85 are welded to brackets 86 and 87 so as to be immovable with respect thereto. In all other respects alternate embodiment 80 is functionally equivalent to embodiment 10.

Thus, it will be seen that the exercising machine provided by the present invention provides an efficient way in which to condition stick handling and shot making muscles off the ice or in the off-season. The invention has the advantage of being relatively lightweight, inexpensive and safe to use without supervision, so that it may be economically and safely deployed in homes, park houses, schools and other training facilities. Although the invention has been described herein in its perferred form with respect to specific details of structure and function, it shall be understood that many modifications and alterations my be made thereto without departing from the spirit and scope of the claims appended thereto.

What is claimed is:

1. An exercise machine for a hockey player exercising with a hockey stick in an exercise area having a floor, said machine comprising:

a base portion (22) and an elevated portion (20);

means for rigidly mounting said base portion in close proximity to said floor and for rigidly mounting said elevated portion above said base portion and in spaced relation thereto;

a plurality of fixed base attachment points (22',22'',22''') connected to said base portion, said plurality including a first, second and third base attachment points with said third base attachment point (22''') disposed in close proximity to said floor and with said second base attachment point (22'') disposed intermediate said first (22') and third (22''') base attachment points;

a plurality of fixed elevated attachment points (20',20'',20''') on said elevated portion (20), said plurality including first, second and third elevated attachment points disposed in generally vertical alignment above said first, second and third base attachment points;

a plurality of pulleys including first (47) and second (46) fixed pulleys and first (32) and second (30) movable pulleys;

a cable (50) having first (50') and second (50'') ends;

a plurality of elastic resistance members (38,38',39,39') each having first and second ends;

means for releasably attaching said first fixed pulley (47) to either of said second fixed base atachment point (22'') and said second fixed elevated attachment point (20'');

means for releasably attaching said second fixed pulley (46) to either of said third fixed base attachment point (22''') and said third fixed elevated attachment point (20''') with said second fixed pulley (46) attached to said base portion (22) when said first fixed pulley (47) is attached to said base portion (22), and said second fixed pulley (46) attached to said elevated portion (20) when said first fixed pulley (47) is attached to said elevated portion (20);

means for releasably attaching said first end (50') of said cable (50) to said first fixed base attachment point (22') when said fixed pulleys (47,46) are attached to said base portion (22) and means for releasably attaching said first end (50') of said cable (50) to said first fixed elevated attachment point (20') when said fixed pulleys (47,46) are attached to said elevated portion (20);

means for attaching a first end of a first (39',38') of said elastic members to said first movable pulley (32) and attaching a second end of said first elastic member to either of said first and second elevated attachment points (20',20'') and said first and second base attachment points (22',22'') when said fixed pulleys (47,46) are attached to said base portion (22) and said elevated portion (20), respectively;

means for attaching a first end of a second of said elastic members (38,39) to said second movable pulley (30) and attaching a second end of said second elastic members to either of said second and third elevated attachment points 20'',20''') and said second and third base attachment points (22'',22''') when said fixed pulleys (47,46) are attached to said base portion (22) and said elevated portion (20), respectively;

means for optionally attaching first ends of additional elastic members (38, 38', 39, 39') to either of said first and second movable pulleys (32,30) and second ends of said additional elastic members to said elevated attachment points (20',20'',20''') when said fixed pulleys (47,46) are attached to said base portion (22) and to said base attachment points (22',22'',22''') when said fixed pulleys (47,46) are attached to said elevated portion;

said cable (50) extending from said first end (50′) and alternately passing through said first elevated pulley (32), said first fixed pulley (47), said second elevated pulley (30) and said second fixed pulley (46);

a hockey stick having a predetermined point (72, 74) of attachment; and attaching means (60) for attaching said second end (50″) of said cable to a hockey stick at said predetermined point (72,74) of attachment.

2. A machine according to claim 1 wherein said hockey stick includes a blade and a tip, said ataching means including means for releasably attaching said cable second end to said tip and means for releasably attaching said cable second end to a point on said blade displaced from said tip.

3. A machine according to claim 1 wherein said cable is sized and said pulleys are disposed for said cable to extend between a rest position and an extended position with the distance between said extended and rest positions approximating a distance traveled by a blade of a hockey stick during a hockey stick stroke.

* * * * *